US009844786B2

(12) United States Patent
Mackel et al.

(10) Patent No.: US 9,844,786 B2
(45) Date of Patent: Dec. 19, 2017

(54) CENTRIFUGE WITH A DRUM AND A HOUSING FILLABLE WITH A FLUID COOLANT AND SOLID DEADENING MEDIA

(75) Inventors: Wilfried Mackel, Lippetal-Herzfeld (DE); Andreas Penkl, Lippetal (DE); Thomas Bathelt, Oelde (DE); Reinhard Moss, Ennigerloh (DE)

(73) Assignee: GEA Mechanical Equipment GmbH, Oelde (DE)

( * ) Notice: Subject to any disclaimer, the term of this patent is extended or adjusted under 35 U.S.C. 154(b) by 605 days.

(21) Appl. No.: 14/232,553

(22) PCT Filed: Jul. 2, 2012

(86) PCT No.: PCT/EP2012/062806

§ 371 (c)(1),
(2), (4) Date: Mar. 21, 2014

(87) PCT Pub. No.: WO2013/007546

PCT Pub. Date: Jan. 17, 2013

(65) Prior Publication Data

US 2014/0200128 A1 Jul. 17, 2014

(30) Foreign Application Priority Data

Jul. 14, 2011 (DE) ..... 10 2011 107 158

(51) Int. Cl.
*B04B 15/02* (2006.01)
*B04B 7/02* (2006.01)

(52) U.S. Cl.
CPC ..... *B04B 15/02* (2013.01); *B04B 7/02* (2013.01)

(58) Field of Classification Search
CPC .. B04B 15/02; B04B 7/02; B04B 7/12; B04B 7/14

(Continued)

(56) References Cited

U.S. PATENT DOCUMENTS 3,804,324 A * 4/1974 Sinn ..... B04B 7/02 220/645
3,981,437 A * 9/1976 Hemfort ..... B01L 7/00 494/13

(Continued)

FOREIGN PATENT DOCUMENTS

CN 201702031 U 1/2011
DE 1 501 284 C 9/1970

(Continued)

OTHER PUBLICATIONS

German Search Report with partial English translation dated Jun. 11, 2012 (ten (10) pages).

(Continued)

*Primary Examiner* — Charles Cooley
*Assistant Examiner* — Shuyi S Liu
(74) *Attorney, Agent, or Firm* — Crowell & Moring LLP

(57) ABSTRACT

A centrifuge, in particular a separator, includes a rotatable centrifuge drum with a vertical axis of rotation and a non-rotatable fixed housing with a hood and preferably a solids collector. In the centrifuge, the housing, in particular the fixed hood and/or at least one other part of the housing, have at least one first inner wall and a first outer wall which delimit a first cavity. The cavity is at least partly filled with damping/insulation agents that are solid at a process or ambient temperature. A coolant that has a fluid form at a process and/or ambient temperature can be introduced into the first cavity filled with the solid damping/insulation agents.

15 Claims, 1 Drawing Sheet

(58) Field of Classification Search
USPC ..... 494/14, 60, 82
See application file for complete search history.

(56) References Cited

U.S. PATENT DOCUMENTS

| | | | | |
|---|---|---|---|---|
| 4,033,563 | A | 7/1977 | Jakobs et al. | |
| 2005/0233884 | A1* | 10/2005 | Hayasaka | B04B 7/06 494/60 |

FOREIGN PATENT DOCUMENTS

| | | | | |
|---|---|---|---|---|
| DE | 24 23 319 | B2 | 2/1976 | |
| DE | 25 18 796 | A1 | 11/1976 | |
| DE | 196 53 377 | A1 | 6/1998 | |
| DE | 100 46 868 | A1 | 4/2002 | |
| DE | 10046868 | A1 * | 4/2002 | B23Q 1/015 |
| EP | 1 090 687 | A1 | 4/2001 | |
| GB | 1096461 | A | 12/1967 | |

OTHER PUBLICATIONS

International Search Report dated Dec. 14, 2012 with English translation (eight (8) pages).
German-language Written Opinion (PCT/ISA/237) dated Dec. 14, 2012 (six (6) pages).
English Translation of Chinese Office Action dated Feb. 12, 2015 (one (1) page).

* cited by examiner

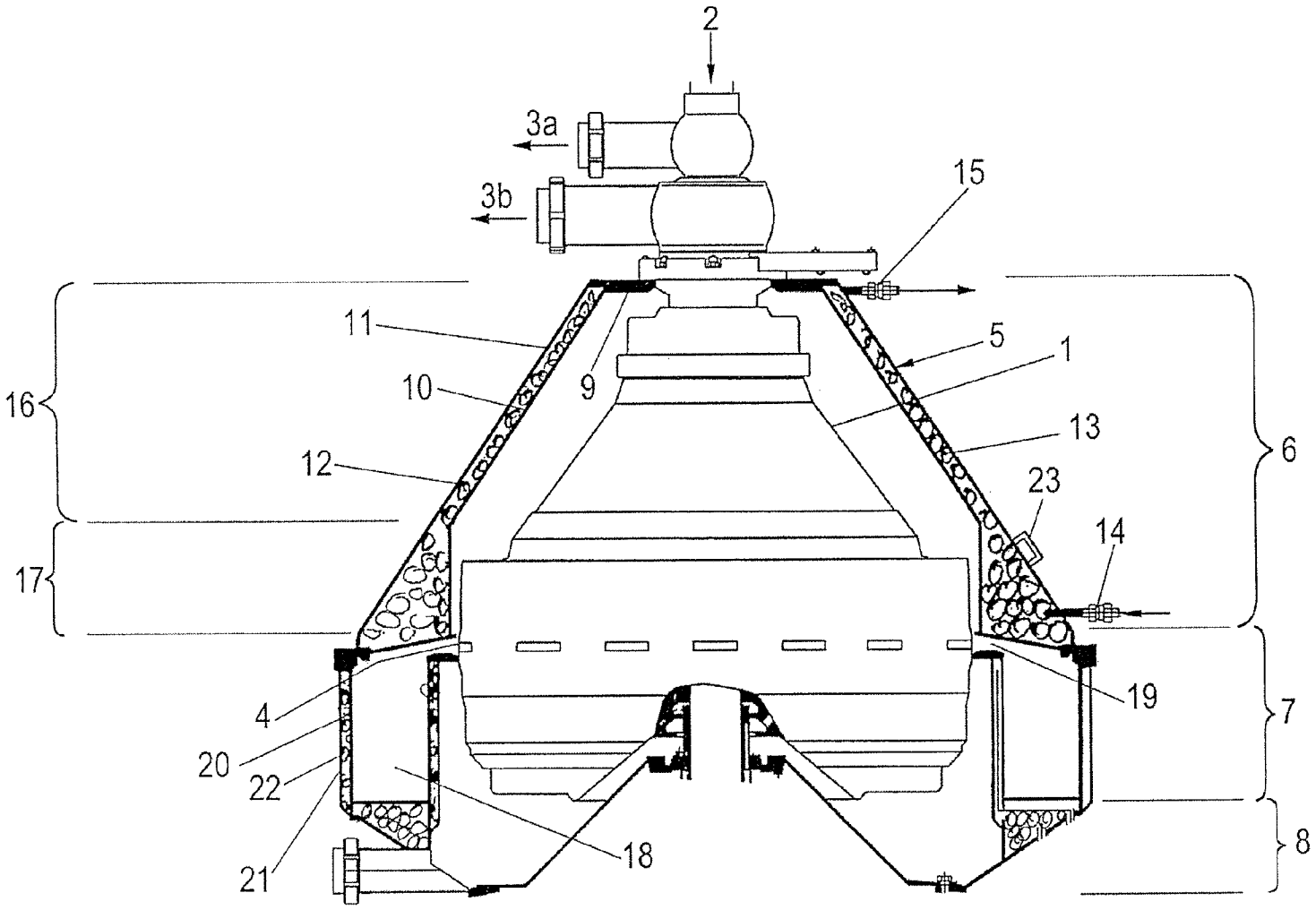
6
7
8
1
2
3a
3b
4
5
9
10
11
12
13
14
15
16
17
18
19
20
21
22
23

CENTRIFUGE WITH A DRUM AND A HOUSING FILLABLE WITH A FLUID COOLANT AND SOLID DEADENING MEDIA

BACKGROUND AND SUMMARY OF THE INVENTION

The invention relates to a centrifuge, in particular a separator, having a rotatable centrifuge drum with a vertical axis of rotation and a non-rotatable, positionally fixed housing, which has a hood and preferably a solids collector.

EP 1 090 687 A1 discloses a separator with a drum and with a hood surrounding the drum, the housing wall of which hood, as per FIG. 2 of said citation, has three spaced-apart walls. Of the cavities formed between the walls, a first cavity accommodates a coolant and a second cavity accommodates a noise insulation medium. This construction is relatively complex.

It is therefore the object of the present invention to provide a centrifuge with a positionally fixed, multi-part housing with a hood and a solids collector, wherein at least the housing ensures a cooling action and a noise deadening action and is furthermore distinguished by a simpler and more compact design.

The invention achieves said object by providing a centrifuge according to the invention, in particular a separator, having a rotatable centrifuge drum with a vertical axis of rotation and a positionally fixed housing. Here, the positionally fixed housing—in particular a hood, a solids collector and/or a frame—has at least one first cavity. The one cavity is filled with deadening material which is in a solid state of aggregation at a corresponding process and/or ambient temperature and which permits deadening of vibrations and noise deadening. A fluid coolant, preferably a liquid, can be introduced into the cavity filled with solid deadening media.

As a result of the combination of coolant and gravel filling, it is achieved, with a compact design, that the rigidity, the mass and also the damping and thus the vibration characteristics of the overall system are advantageously influenced.

As a result of the combination of "coolant" and "deadening material" functions in one and the same cavity, it is achieved that noise deadening, and simultaneously a good distribution of the coolant within the cavity, in particular between the first inner wall and the first outer wall of the housing (on the hood, on the solids collector and/or on the frame), are realized in a compact design.

The design is furthermore optimized in terms of installation space, and is particularly compact, in relation to the prior art.

The first outer wall and/or the first inner wall may have at least one first coolant inlet line and one first coolant outlet line for the introduction and discharge of the fluid coolant into and out of the first cavity filled with solid deadening media.

To prevent a build-up of the coolant and to achieve a particularly good distribution of the coolant over the region of the inner wall of the hood, it is advantageous if, as bulk material, use is made of gravel which has for example a bulk density of 1.4 to 2 kg/dm3 (depending on dampness). The material and bulk density should be such that liquid can easily flow around the bulk material or through the space with the bulk material. A bulk material which becomes saturated with the liquid and does not permit a throughflow, or permits only a very limited throughflow, is thus not suitable. It can be determined in tests whether both the deadening, and also the passage of liquid in the case of a bulk material, meet the requirements.

Here, for a particularly advantageous compact design, it is adequate for the housing, in particular the hood, to be of merely double-walled construction.

From EP 1 090 687 A1, it is known, inter alia, for foamed material to be used as bulk material for noise insulation in a hood. However, foamed material can under some circumstances swell up upon contact with the coolant. It is therefore advantageous to use inorganic solid matter for the bulk material.

To prevent blockage of the coolant outlet line by particles, for example in the form of sand or glass beads, it is furthermore advantageous for the deadening material to be in the form of bulk material in the form of elements, in particular balls, composed of stone, ceramic, glass, stainless steel or plastic. A wide variety of material combinations of the stated elements are also contemplated.

For the most uniform cooling possible, the radial distance between the first inner wall and the first outer wall may advantageously be formed so as to be constant over a partial region of the centrifuge drum, preferably over at least one third of the axial length of the hood.

The centrifuge has at least one solids accumulating chamber, which is advantageously delimited by at least one second inner wall, a cavity filled with bulk material, and a second outer wall, wherein the second cavity can be filled with a coolant. This permits additional cooling of the solids in the solids accumulating chamber, which is advantageous in particular in the case of temperature-sensitive solids products.

To ensure complete filling of the first cavity, it is advantageous for the first coolant inlet to be arranged lower on the outer wall than the first coolant outlet. Here, it is particularly advantageous for the first coolant outlet to be arranged at the upper end of the first cavity, such that complete and comprehensive coolant filling is achieved.

To realize cooling with a greater or lesser level of intensity, it is advantageous if the volume flow of coolant into the cavity can be regulated.

Elements of the housing may additionally be provided with noise-deadening coatings such as bitumen coatings, in order to further optimize the noise deadening.

The bulk material may, but need not imperatively, be composed of round elements such as balls. The elements of the bulk material may have any desired shape as long as intermediate spaces for a throughflow of the cooling liquid are formed. In particular, the elements need not be identical, but rather may also have different shapes. It is also contemplated for different bulk materials to be combined in order to achieve particularly good noise deadening.

The invention is suitable for centrifuges of a variety of types, in particular separators and decanters.

Different variants of the invention will be explained in more detail below on the basis of the drawing.

BRIEF DESCRIPTION OF THE DRAWING

The FIGURE is a schematic sectional view of a subregion of a centrifuge according to an embodiment of the invention.

DETAILED DESCRIPTION OF THE DRAWING

The FIGURE shows an exemplary construction of a centrifuge with a centrifuge drum 1, which is rotatable about a vertical axis of rotation. The centrifuge is, in the present exemplary embodiment, in the form of a disk separator.

The centrifuge drum 1 has an inlet 2 and two liquid outlets 3*a* and 3*b* and also solids discharge openings 4. The rotatable centrifuge drum 1 is surrounded by a positionally fixed housing with a hood 5 which is of double-cone form. Here, the housing has an elongate upper conical region 6, a cylindrical central segment 7 and a lower conical region 8, wherein in this case, by way of example, the two latter regions together form the solids collector.

The hood 5 terminates in the upper conical region with an annular frame 9. The hood 5 has a double-walled construction with a first inner wall 10 and a first outer wall 11. Between the first inner wall 10 and the first outer wall 11 there is arranged a first cavity 12 which is filled with deadening material, preferably a relatively coarse-grained bulk material 13, in particular with gravel stones, and which is delimited in the upward direction by the annular frame 9. On the outer wall 11 there is arranged a first coolant inlet 14 which enables coolant to be conducted into the first cavity 12 filled with bulk material. The first coolant inlet 14 is arranged in the lower half of the positionally fixed hood 5, before the transition from the upper conical region 6 of the hood 5 into the cylindrical central segment 7 or the solids collector.

A first coolant outlet 15 is arranged above the first coolant inlet 14 on the outer wall 11 in the region of the upper half of the positionally fixed hood 5, before the transition of the conical region 6 of the hood 5 into the annular region 9, and enables coolant to be discharged out of the first cavity 12 filled with bulk material.

The cavity 12 may also be divided into regions which are filled differently, for example with different materials. It is also possible for only a part of the intermediate space to be cooled and/or filled with the bulk material.

The upper conical region 6 has, in this case, for example, an upper segment 16 and a lower segment 17. In the region of the upper segment 16, the first inner wall 10 and the first outer wall 11 are spaced apart uniformly from one another in the radial direction, such that the wall thickness of the double-walled hood 5 is uniform along the upper segment 16. In the region of the lower segment 17, the first inner wall 10 has a cylindrical form, whereas the first outer wall 11 forms a continuation of the conical profile. In this way, in the vertical profile of the lower segment 17, there is a widening of the first cavity 12 filled with bulk material, and an increase of the wall thickness of the double-walled hood 5.

In the region of the cylindrical central segment 7, the solids collector has one or more solids accumulating chambers 18. Via one or more openings 19 in the solids accumulating chamber 18, the solids emerging from the solids discharge openings 4 pass into the solids accumulating chamber 18. The solids accumulating chamber 18 is delimited by a second inner wall 20 and a second outer wall 21, between which there is arranged a second hollow cavity 22 filled with bulk material.

In a first exemplary embodiment, the second cavity 22 may have an autonomous coolant supply, wherein a second coolant inlet (not illustrated here) and a second coolant outlet for the supply of a coolant into the second cavity 22 are arranged on the outer wall 21. In this way, the cooling of the centrifuged solids can be realized independently of the cooling of the cylinder drum 2.

Alternatively, the second cavity 22 may also be connected to the first cavity 12, such that uniform cooling of the entire centrifuge is achieved.

As bulk material, use is preferably made of stone, in particular in the form of gravel. Here, the bulk material preferably has a grain of at least 2 mm, in particular at least 4 mm minimum grain size. Grain groups are designated by the specification of two delimiting screens. The grain is preferably 2-4 or 2-8 or 4-8 or 2-16 mm or 8-16 mm (grain specification: minimum mm-maximum mm grain size within the grain) in order to achieve good results for an adequate throughflow for cooling and good noise deadening.

Furthermore, in particular the outer wall 11, 21 of the housing may be designed with noise-insulating and/or heat-insulating action. The inner wall may also be designed configured with noise-deadening properties. This has the advantage that additional noise deadening is ensured, there is only little exchange of ambient heat with the coolant, and the cooling action of the coolant endures for longer. For this purpose, the outer wall may, for example, have a heat-insulating foamed material layer.

In a further refinement of the invention, the deadening material may for example also be in the form of strip-like sections through which flow can pass, or in the form of projections on the first and/or second inner wall, which projections protrude into the cavity and possibly come into contact with the respective first and/or second outer wall. Conversely, it is also possible for the first and/or second outer wall to have such strip-like sections or projections through which flow can pass.

In a further embodiment variant, the coolant inlet line 14 and/or the coolant outlet line 15 may alternatively also be arranged on the first and/or second inner wall 10 of the hood 5.

As a preferred fluid coolant, use is preferably made of a liquid. It is particularly preferable for water or a salt solution to be used as fluid coolant, for example in the case of operating temperatures between 5 and 70° C.

Table of Reference Signs

| | |
|---|---|
| 1 | Centrifuge drum |
| 2 | Inlet |
| 3a | Liquid outlet |
| 3b | Liquid outlet |
| 4 | Solids discharge opening |
| 5 | Hood |
| 6 | Upper conical region |
| 7 | Central segment (solids collector) |
| 8 | Lower conical region (solids collector) |
| 9 | Frame |
| 10 | First inner wall |
| 11 | First outer wall |
| 12 | First cavity |
| 13 | Bulk material |
| 14 | Coolant inlet |
| 15 | Coolant outlet |
| 16 | Upper segment |
| 17 | Lower segment |
| 18 | Solids accumulating chamber |
| 19 | Opening |
| 20 | Second inner wall |
| 21 | Second outer wall |
| 22 | Second cavity |
| 23 | HandleBackground |

The invention claimed is:

1. A centrifuge having a rotatable centrifuge drum with a vertical axis of rotation, the centrifuge comprising:

a non-rotatable, positionally fixed housing with a hood, wherein the housing delimits at least one first cavity at least partly filled with deadening media that are solid at a process or ambient temperature, a coolant, having a fluid form at the process or ambient temperature, introduced into the first cavity at least partly filled with the deadening media, wherein the first cavity has a first inner wall and a first outer wall, and further wherein the first inner and/or the first outer wall have at least one first coolant inlet line and one first coolant outlet line for the introduction and discharge of the coolant into and out of the first cavity filled with the deadening media, and wherein the centrifuge has at least one solids accumulating chamber which is delimited by at least one second inner wall, a second cavity filled with deadening media, and a second outer wall, wherein the second cavity is finable with a coolant via a second coolant inlet line or via the second cavity being connected to the first cavity.

2. The centrifuge according to claim 1, wherein the housing includes the at least one solids accumulating chamber.

3. The centrifuge according to claim 1, wherein the centrifuge is a separator.

4. The centrifuge according to claim 1, wherein the deadening media is a bulk material.

5. The centrifuge according to claim 4, wherein the bulk material has a minimum grain size so as to be traversed by a flow of the coolant.

6. The centrifuge according to claim 4, wherein the bulk material has a minimum grain size of 2 mm.

7. The centrifuge according to claim 4, wherein the bulk material has a minimum grain size of 4 mm.

8. The centrifuge according to claim 4, wherein the bulk material is composed of inorganic solid matter.

9. The centrifuge according to claim 4, wherein the bulk material is stone.

10. The centrifuge according to claim 4, wherein the bulk material is a gravel or a gravel mixture.

11. The centrifuge according to claim 1, wherein the hood is of a double-walled form.

12. The centrifuge according to claim 1, wherein a radial spacing between the first inner wall and the first outer wall is constant over a partial region of the housing.

13. The centrifuge according to claim 1, wherein the coolant inlet is arranged lower on the first outer wall than the coolant outlet.

14. The centrifuge according to claim 13, wherein the coolant outlet is arranged at an upper end of the first cavity.

15. The centrifuge according to claim 1, wherein the first and/or the second outer wall of the hood has a heat-insulating foamed material layer.

* * * * *